US011585616B1

(12) United States Patent
Witecha

(10) Patent No.: US 11,585,616 B1
(45) Date of Patent: Feb. 21, 2023

(54) FIREARM MAGAZINE WITH SPRING LOCKING DEVICE AND METHOD FOR LOADING SAME

(71) Applicant: Kirk Joseph Witecha, Delray Beach, FL (US)

(72) Inventor: Kirk Joseph Witecha, Delray Beach, FL (US)

( * ) Notice: Subject to any disclaimer, the term of this patent is extended or adjusted under 35 U.S.C. 154(b) by 0 days.

(21) Appl. No.: 17/361,916

(22) Filed: Jun. 29, 2021

Related U.S. Application Data

(60) Provisional application No. 63/114,766, filed on Nov. 17, 2020, provisional application No. 63/045,328, filed on Jun. 29, 2020.

(51) Int. Cl.
*F41A 9/67* (2006.01)

(52) U.S. Cl.
CPC ..... *F41A 9/67* (2013.01)

(58) Field of Classification Search
CPC ..... F41A 9/65; F41A 9/66; F41A 9/67; F41A 9/70
See application file for complete search history.

(56) References Cited

U.S. PATENT DOCUMENTS

| | | | | | |
|---|---|---|---|---|---|
| 1,645,031 | A * | 10/1927 | Von Frommer | F41A 9/67 | 42/50 |
| 1,797,951 | A * | 3/1931 | Gaidos | F41A 9/67 | 42/50 |
| 4,430,821 | A * | 2/1984 | Vincent | F41A 9/67 | 42/50 |
| 4,514,922 | A * | 5/1985 | Farrar | F41A 9/65 | 42/50 |
| 4,688,344 | A * | 8/1987 | Kim | F41A 9/83 | 42/88 |
| 5,291,679 | A * | 3/1994 | Wollack | F41A 9/67 | 42/50 |
| 5,450,683 | A * | 9/1995 | Miller, IV | F41A 9/65 | 42/50 |
| 9,303,934 | B1 * | 4/2016 | Kazsuk | F41A 9/83 | |
| 9,752,838 | B2 * | 9/2017 | Parker | F41A 9/67 | |
| 2007/0157501 | A1 * | 7/2007 | Cammenga | F41A 9/67 | 42/87 |
| 2018/0292152 | A1 * | 10/2018 | Wilkinson | F41A 9/84 | |
| 2020/0096271 | A1 * | 3/2020 | Vito | F41A 9/67 | |

* cited by examiner

*Primary Examiner* — Gabriel J. Klein
(74) *Attorney, Agent, or Firm* — Edell, Shapiro & Finnan, LLC

(57) ABSTRACT

A method and associated device that compresses a magazine spring and locks it in place to facilitate loading of cartridges in the magazine. A spring locking device, which might be integrated with a follower that rides atop the magazine spring, includes a single or a pair of flexible quick release tabs that pass through one or more through holes in the magazine and which can be easily unhooked or released to permit the magazine spring to decompress and urge any cartridges in the magazine toward the top of the magazine.

25 Claims, 9 Drawing Sheets

FIREARM MAGAZINE WITH SPRING LOCKING DEVICE AND METHOD FOR LOADING SAME

CROSS-REFERENCE TO RELATED APPLICATIONS

This application claims priority to U.S. Provisional Patent Application Nos. 63/045,328, filed on Jun. 29, 2020, and 63/114,766, filed on Nov. 17, 2020, the disclosures of which are incorporated by reference herein in their entirety.

TECHNICAL FIELD

The present disclosure relates to improvements in firearm magazines and methods of loading same.

BACKGROUND

Traditional high capacity firearm magazines, such as the example handgun magazine 100 shown in FIGS. 1-3, may be difficult for a person to load. Especially difficult are column magazines capable of holding up to 15, or even more, rounds or cartridges of ammunition. Such magazines typically include a tubular housing 102 containing a movable follower 104 upon which rounds 106 may be stacked in one or two columns and a strong spring 108 disposed between a base plate assembly 110 at a bottom of the housing and the follower. The spring 108 exerts an upward force on the follower 104 to hold the stack of rounds in compression between the follower and feed lips 112 at the top of the magazine housing. Substantial finger pressure is required to overcome the upward force exerted by the magazine spring 108 on the follower 104 (or on rounds stacked above the follower) in order to create a space under the feed lips 112 for a new round to be inserted and may cause injury or damage to the thumb of the person loading the column magazine.

SUMMARY OF THE INVENTION

A first aspect of the invention is directed to a device for locking a spring in a compressed state in the housing of a magazine to facilitate loading cartridges into the magazine. The device comprises a follower configured to fit within the magazine housing and to engage with a top of the spring. The follower includes a top side configured to contact a cartridge loaded in the magazine, and a bottom side that may include a flexible protrusion extending therefrom and having a tab at a distal end thereof. The device may also comprise a through hole formed in a component of the magazine and configured to receive the tab when the follower is located in a loading position proximate a bottom of the magazine housing with the spring in a compressed state. The flexible protrusion may further be configured to be movable between undeflected and deflected states, and movement of the flexible protrusion from the deflected state to the undeflected state in the loading position causes the tab at the distal end of the flexible protrusion to extend at least partly through the through hole and to engage a portion of the magazine adjacent the through hole so as to lock the follower in the loading position and hold the magazine spring in the compressed state to facilitate loading the magazine. In example embodiments, the through hole may be formed through a base plate assembly configured to couple with a bottom of the magazine housing. In other example embodiments, the through hole may be formed through a side wall of the magazine housing.

A second aspect of the invention is directed to a method of loading a firearm magazine having a magazine housing, a base plate assembly coupled with a bottom of the magazine housing, a follower disposed within the magazine housing, and a spring disposed between the follower and the base plate assembly. The method may comprise the step of pushing the follower downwardly within the magazine housing using a pusher, thereby compressing the spring. The method may further comprise locking the follower in a loading position proximate a bottom of the magazine housing by causing a tab at a distal end of a flexible protrusion on the follower to be received in a through hole formed in the magazine housing. The method may further comprise dropping one or more cartridges into the housing, and depressing the tab so that it is released from the through hole and the spring may decompress, thereby moving the follower upwardly within the magazine to a loaded position in which the one or more cartridges are held in compression between the follower and a top of the magazine. In example embodiments, locking the follower in the loading position comprises causing the tab at the distal end of the flexible protrusion to be received in a through hole formed in the base plate assembly. In other example embodiments, locking the follower in the loading position comprises causing the tab at the distal end of the flexible protrusion to be received in a through hole formed in a side wall of the magazine housing.

A third aspect of the invention is directed to a method of adding a spring locking device to a firearm magazine having a magazine housing, an original base plate assembly coupled with a bottom of the magazine housing, an original follower disposed within the housing, and a spring disposed between the original follower and the original base plate assembly. The method may comprise the step of replacing the original follower with a replacement follower configured to fit within the magazine housing and also to engage with a top of the spring, the replacement follower having a top side configured to contact a cartridge loaded in the magazine, and a bottom side including a flexible protrusion extending therefrom and having a tab at a distal end thereof. The method may further comprise the step of forming a through hole in the magazine, wherein the through hole is configured to receive the tab when the replacement follower is located in a loading position proximate a bottom of the magazine housing with the spring in a compressed state, and wherein the flexible protrusion is configured to move from a deflected state to an undeflected state in which the tab extends into the through hole and engages the magazine to lock the magazine spring in the compressed state to facilitate loading the magazine. In an example embodiment, forming a through hole in the magazine comprises replacing the original base plate assembly with a replacement base plate assembly having a through hole formed therein.

BRIEF DESCRIPTION OF THE DRAWINGS

FIG. 12 also shows a concave recess in a bottom surface of the base plate.

DESCRIPTION OF EXAMPLE EMBODIMENTS

Overview

Figure 3:
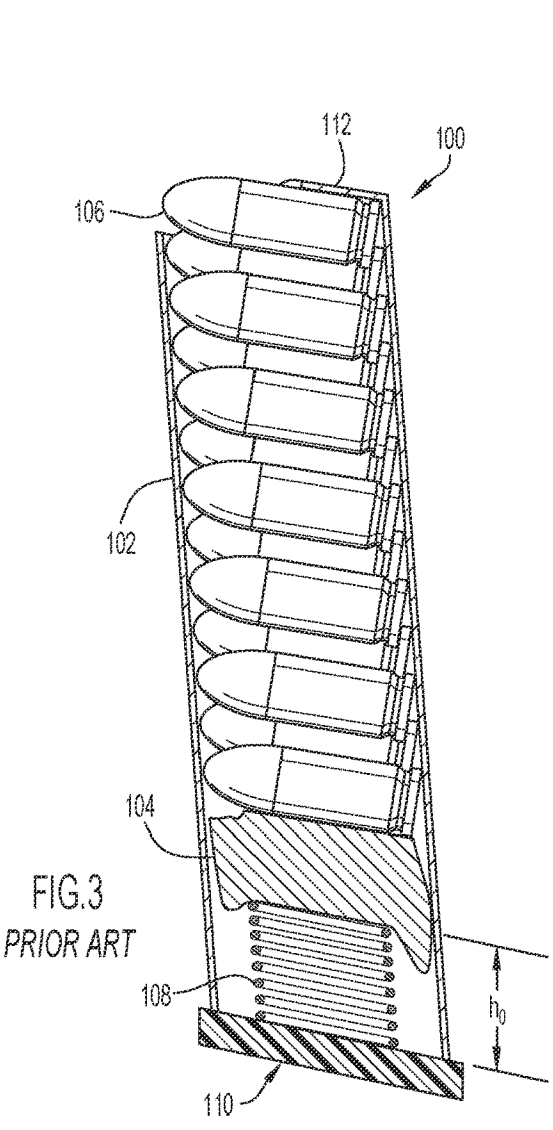
FIG.3 PRIOR ART
FIG. 3 is a cross-sectional side view of the prior art column magazine in a fully loaded state or condition in which the maximum number of rounds have been loaded and the magazine spring exerts an upward force on the follower to hold the stack of rounds in compression between the follower and the feed lips.
Figure 2:
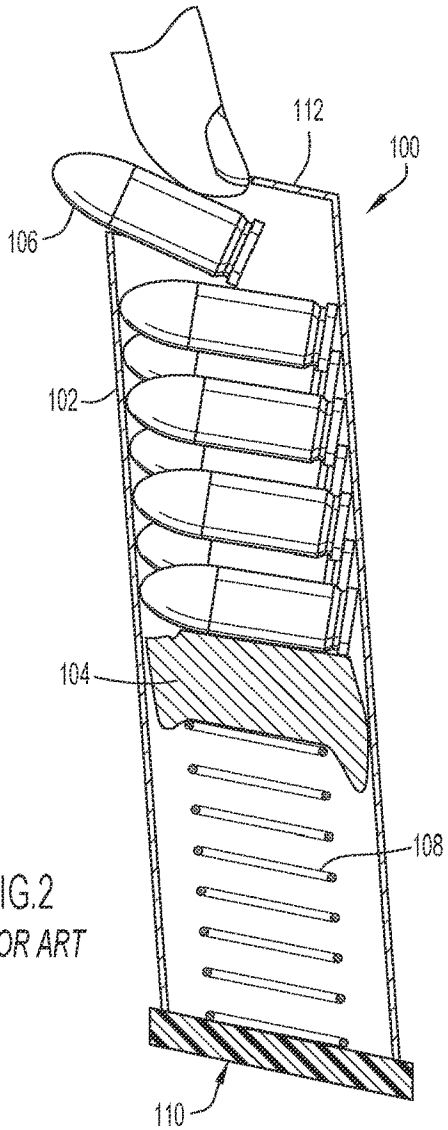
FIG.2 PRIOR ART
FIG. 2 is a cross-sectional side view of the prior art column magazine in a partially loaded state or condition in which less than a maximum number of rounds have already been loaded and in which a user is trying to load a new round into the magazine by pressing the back end of the new round downwardly against the stack of already loaded rounds to compress the spring and thereby create a space under the feed lips for the new round.
Figure 1:
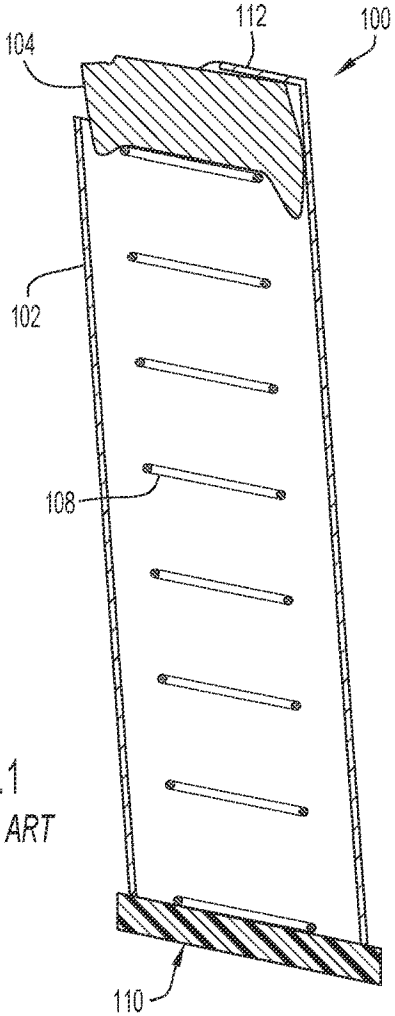
FIG.1 PRIOR ART
FIG. 1 is a cross-sectional side view of a prior art column magazine in an unloaded state or condition in which the magazine spring is in a decompressed or relaxed state or condition positioning the follower proximate feed lips at the top of the magazine housing.

The described embodiments provide an approach to more easily fill or load a magazine with cartridges by, prior to loading, compressing the magazine spring with, e.g., a plunger or pusher, and then locking the magazine spring in a compressed state using a spring locking device or device that might be integrated with a follower that rides atop the magazine spring. The spring locking device might include a single, or a plurality of, flexible quick release tabs that pass through one or more through holes in a base plate assembly of a magazine, or through holes in walls of the magazine, and which can be easily unhooked to permit the magazine spring to decompress and urge any cartridges in the magazine toward the top of the magazine.

Example Embodiments

FIGS. 4-11 show a magazine 200 with a spring locking device according to a first example embodiment. The magazine comprises a tubular housing 102 with an opening 114 at a top thereof to receive rounds or cartridges 106. A rear portion of the opening at the top of the housing 102 is partially obstructed by a pair of feed lips 112 extending towards one another from opposite sides of the opening. The feed lips 112 are separated by a gap that is smaller than a diameter of a cartridge casing to prevent the uppermost cartridge from passing through the gap while allowing the bolt of a firearm to extend through the gap in order to engage the uppermost cartridge in the magazine and slide it out from under the lips in a forward direction so that it may be loaded into the firing chamber of the firearm via the front portion of the opening 114. The magazine further comprises a base plate assembly 210 coupled with a bottom of the housing 102, a spring 108 disposed within the housing, and a follower 204 configured to fit within the housing and engage a top of the spring.

Figure 4:
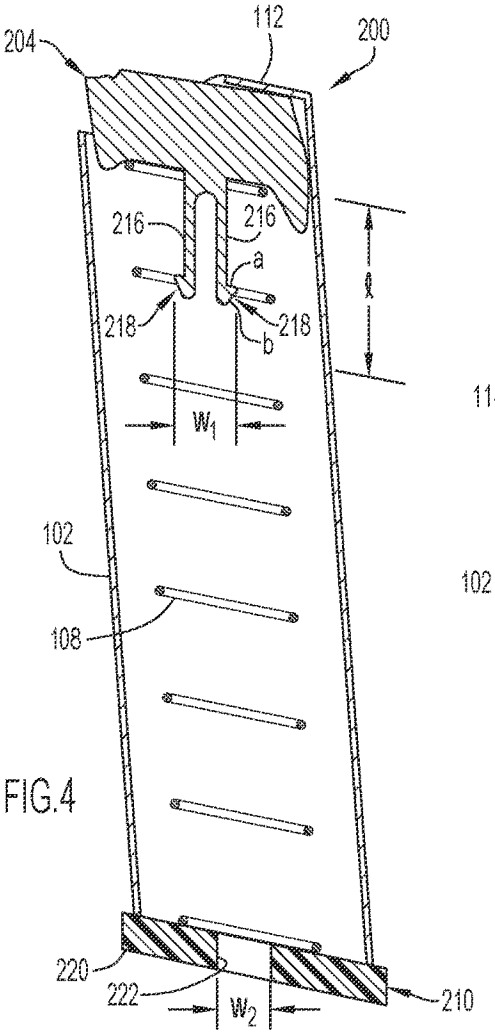
FIG. 4 is a cross-sectional side view of a magazine with a spring locking device according to a first example embodiment illustrating a magazine spring in a decompressed or relaxed state positioning a follower proximate a top of the magazine housing, and flexible protrusions extending downwardly from the follower in an undeflected or relaxed state or condition.

The follower 204 comprises a top side configured to contact a cartridge loaded in the magazine, and a bottom side including a pair of flexible protrusions 216 extending downward from a central portion thereof. In the example embodiment, the spring 108 is shown as a helical spring with coils, and the flexible protrusions 216 are shown extending through coils of the spring. The flexible protrusions 216 are generally parallel to, and spaced apart from, one another in an undeflected state or condition in which the protrusions are not stressed (e.g., as shown in FIG. 4), but may be angled inwardly or outwardly relative to one another in the undeflected state so long as distal ends of the flexible protrusions are spaced slightly apart and are capable of being deflected toward one another when squeezed together. The flexible protrusions may be formed of any suitable material that provides the necessary flexibility and strength to perform the functions described herein, including without limitation plastic, metal, and/or composite materials. Preferably, the material is an elastic material that permits the flexible protrusions to be moved from an undeflected state in which the flexible protrusions are relaxed (or unloaded) to a deflected state in which the flexible protrusions are elastically deformed. Those of ordinary skill in the art will appreciate that, when the force causing the flexible protrusions to deflect is removed, the flexible protrusions will automatically return to their undeflected state.

A tab 218 is located at a distal end of each flexible protrusion 216. The tabs 218 extend laterally outward from the flexible protrusions 216 in opposite directions (e.g., forwardly and rearwardly, respectively, as shown). In the example embodiment, each tab 218 is generally triangular in shape, with an upper edge a generally parallel to a bottom of the baseplate assembly 210 and a lower edge b extending downwardly at an oblique angle relative to the upper edge from an outward side of the tab to an inward side of the tab to define a ramp. A width $w_1$ of the flexible protrusions 216, measured between outer ends of the tabs 218, is preferably less than an inner diameter of the spring 108 so that the flexible protrusions may extend through a center of the spring without interfering with compression and decompression of the spring. A length l of each flexible protrusion 216 from the bottom of the follower 204 to the upper edge of the corresponding tab 218 preferably corresponds to a height hi of the spring 108 when fully compressed plus a thickness t of the baseplate assembly 210 (see, e.g., FIG. 7). It should be noted that the spring 108 in a magazine may not be fully compressed when the maximum number of cartridges have been loaded into the magazine. That is, it may be possible to further compress the spring 108 a small amount (usually less than a diameter of a cartridge casing) in a fully loaded magazine. Thus, the length l minus the thickness t of the baseplate assembly may be within a range between the height of the spring 108 in a fully compressed state and the height of the spring when the magazine is fully loaded with a maximum number of cartridges.

The baseplate assembly 210 in this example embodiment is a baseplate 220 that engages the bottom of the magazine housing 102. For example, the baseplate 220 may have slots formed therein to slide onto rails formed on the bottom of the magazine housing 102. (In other example embodiments, the baseplate assembly may additionally include a retainer plate configured to fit within the magazine housing 102 above the baseplate. The retainer plate may include a pin or the like that extends from the retainer plate into a locking hole formed in the baseplate to prevent the baseplate from sliding relative to the magazine housing, while also allowing removal of the baseplate by depressing the pin. See, e.g., FIGS. 12-19, 21D and 21E).

Figure 8:
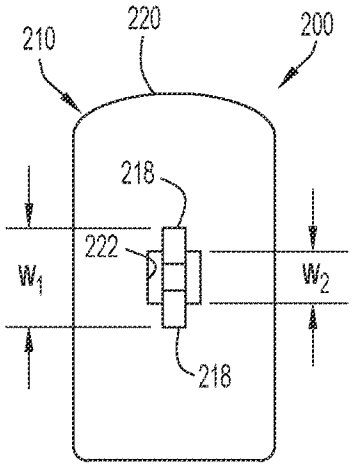
FIG. 8 is a bottom view of the magazine according to the first example embodiment illustrating the tabs of the spring locking device in the locked position.

A through hole 222 is formed in the baseplate 220 to provide a passage for the tabs 218 to extend through the baseplate and lock against a bottom of the baseplate when the follower is pushed downwardly to a loading position proximate a bottom of the housing 102 in which the spring 108 is in a compressed state or condition (e.g., when the spring is fully compressed). As best seen in FIG. 8, in this example embodiment, a single through hole 222 having a square opening sized to receive both tabs 218 is formed through a central portion of the baseplate assembly 220 in opposed relation to the tabs. Moreover, a width $w_2$ of the through hole 222 is slightly smaller than a width $w_1$ between outer ends of the tabs 218 so that edges of the through hole are lined-up with angled edges of the tabs. Therefore, as the tabs 218 move downwardly and engage edges of the through hole 222, the angled edges of the tabs act like ramps that cause the flexible protrusions 216 to move from their undeflected state (see, e.g., FIG. 4) to a deflected state in which the tabs are pinched together, and thus elastically deformed, while passing through the through hole (see, e.g., FIG. 6).

FIGS. 5-11 illustrate a method of loading rounds 106 into the magazine 200 according to the first example embodiment. The method may involve using a plunger or pusher 224 to assist in moving the follower 204 downwardly within the housing 102 to a loading position against the upward force exerted on the follower by the spring 108. In the example embodiment shown in FIGS. 5 & 6, the pusher 224 includes a main shaft 226 with proximal and distal ends. The main shaft 226 preferably has a thickness to fit between the feed lips 112 of the magazine (see FIG. 5) and a width to fit between front and rear walls of the magazine housing 102 (see FIG. 6). A handle 228 is preferably provided at the proximal end of the main shaft 226 to facilitate grasping the pusher and applying a downward force. In this example embodiment, the handle 228 is shown as a cap with a generally rectangular cross-section that is wider and longer than the main shaft 226 and provided with curved edges for a comfortable grip. The distal end 230 of the main shaft is preferably configured to engage a top of the follower 204. For example, if the follower 204 is angled relative to a longitudinal axis of the magazine housing 102 as shown, the distal end 230 of the pusher 224 is preferably angled to match the angle of the follower as shown.

Figure 6:
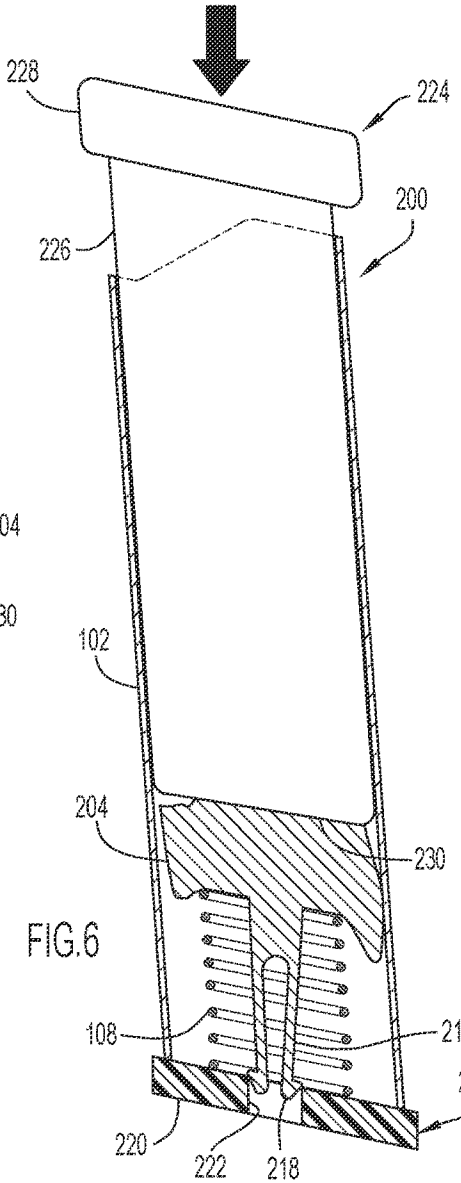
FIG. 6 is a cross-sectional side view of the magazine according to the first example embodiment illustrating how the plunger or pusher may be pushed downwardly against the follower to cause the magazine spring to be compressed and how such compression may initiate operation of the spring locking device by causing tabs at respective distal ends of flexible protrusions extending from a follower to engage edges of a through hole in a base plate assembly to cause the flexible protrusions to deflect and thereby allow the tabs to extend into the through hole.
Figure 5:
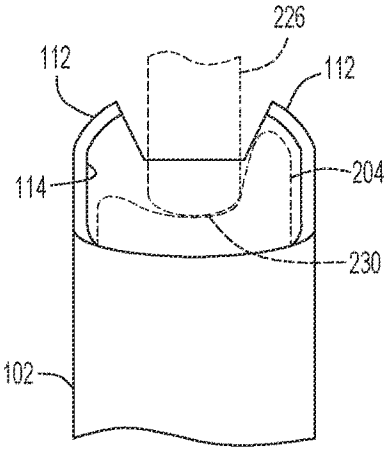
FIG. 5 is front view of a top portion of the magazine according the first example embodiment illustrating the feed lips at the top of the magazine housing, the follower disposed in the housing proximate the feed lips, and an optional plunger or pusher extending through the space between the feed lips to engage the follower.

Referring still to FIGS. 5 & 6, a user seeking to load the magazine 200 with cartridges may position the pusher's main shaft 226 between the feed lips 112 of the magazine such that a distal end of the main shaft engages the follower 204, and may push down on the handle 228 of the pusher to cause the follower to move downwardly within the housing 102 against the force of the spring 108. As the follower 204 is moved downwardly within the housing 102, the spring 108 is compressed between the follower and the baseplate assembly 210. Also, the flexible protrusions 216 move downwardly with the follower 204, extending through a center of the spring's coils towards the through hole 222 in the baseplate assembly 210.

Referring still to FIG. 6, as the user continues to push down on the handle 228 of the pusher 224, the tabs 218 at respective distal ends of the flexible protrusions 216 engage opposite edges of the through hole 222 in the baseplate assembly 210. More specifically, in the example embodiment, angled edges of the tabs 218 engage edges of the through hole 222 and act like ramps to cause the tabs to be deflected toward one another as the tabs enter the through hole. In the deflected condition or state, the flexible protrusions 216 are elastically deformed.

Figure 7:
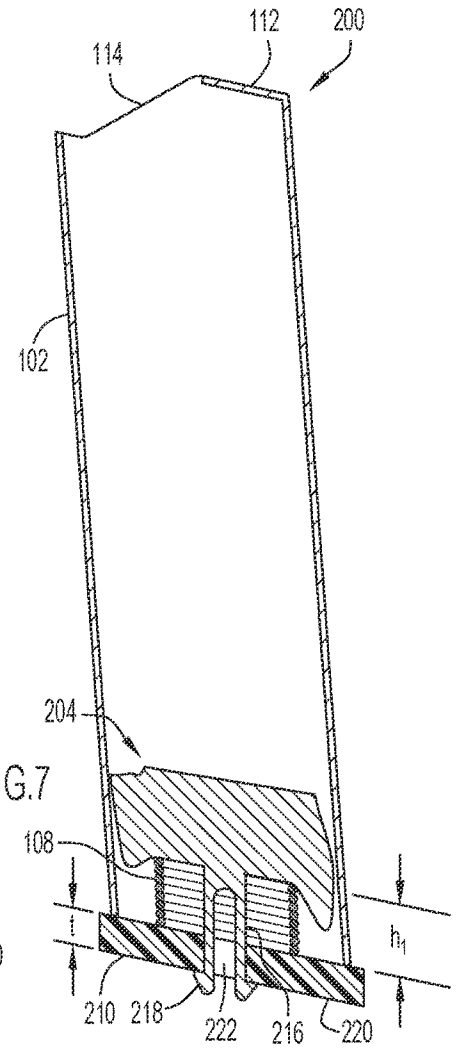
FIG. 7 is a cross-sectional side view of the magazine according to the first example embodiment illustrating how further compression of the magazine spring may cause the tabs to extend through and protrude downwardly from the through hole in the base plate assembly and to be moved to a locked position engaging a bottom surface of the base plate assembly by movement of the resilient protrusions from the deflected state to an undeflected state.

Referring now to FIG. 7, the user may continue pushing down on the handle 228 until the follower 204 reaches a loading position in which the tabs 218 emerge from the bottom of the through hole 222 and move back to their undeflected condition or state. As a result, respective upper edges of the tabs 218 overhang a bottom surface of the baseplate 220 on opposite sides of the through hole 222, thereby locking the follower 204 in the loading position and holding the spring 108 in a compressed state. With the follower 204 in the loading position, the amount of space between a top of the follower and the feed lips 112 is preferably equal to or slightly larger than the height of a maximum number of cartridges that the magazine is designed to hold. At the same time, the spring 108 may be fully or nearly fully compressed and exerting an upward force on the follower 204 and the flexible protrusions 216 extending from the follower. The spring force may be as much as 20 pounds or more, depending on the particular magazine. As a result, respective upper edges of the tabs 218 are caused to engage the bottom of the base plate assembly 210 around the through hole 222 as shown in FIG. 7. The flexible protrusions 216 and tabs 218 are configured to withstand the spring force and will thus prevent upward movement of the follower 204 relative to the magazine housing 102, thereby locking the follower in the loading position and holding the spring 108 in a compressed state. FIG. 8 is a bottom view of the magazine 200 according to the first example embodiment illustrating the tabs 218 of the spring locking device in a locked position.

Figure 9:
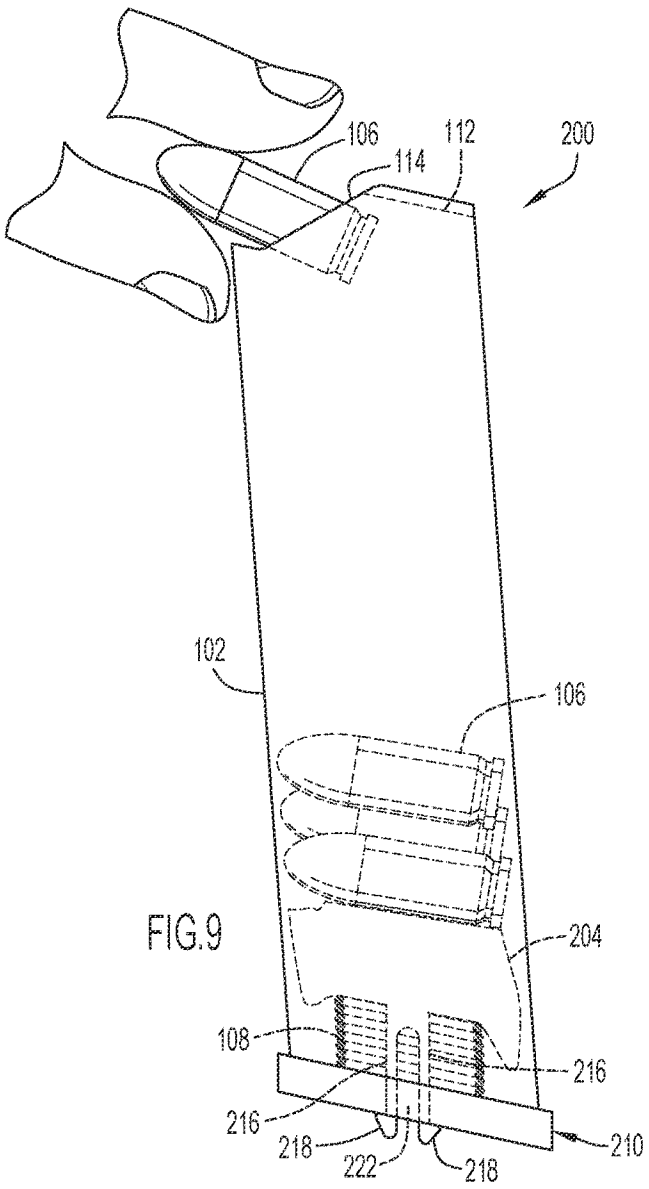
FIG. 9 is a side view of the magazine according to the first example embodiment illustrating how rounds may be loaded into the magazine simply by dropping each round into the magazine housing when the spring is locked in a compressed state or condition by the spring locking device.

Referring now to FIG. 9, with the follower 204 locked in the loading position by the spring locking device, a user may load cartridges 106 into the magazine 200 by simply dropping properly oriented cartridges into the magazine housing 102 via the opening 114 at the top of the magazine housing. The first cartridge will rest on the follower 204, and subsequent cartridges will rest on a previously loaded cartridge. A user may load any desired number of cartridges into the magazine in this manner, up to the maximum number of cartridges that the magazine is designed to hold. For example, in some double stack magazines, a user may load as few as one or up to fifteen cartridges 106 into the magazine housing 102. Because the spring 108 is locked in a compressed condition by the spring locking device, finger pressure is not required to load the cartridges 106 into the magazine 200.

Figure 10:
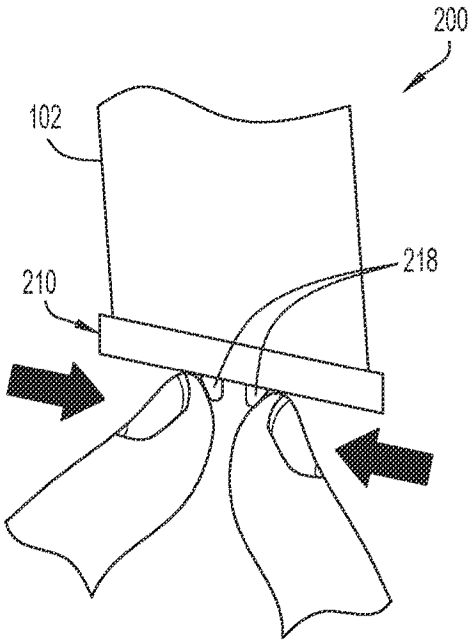
FIG. 10 is a partial side view of a bottom portion of the magazine according to the first example embodiment showing how the spring locking device may be unlocked by pinching or squeezing the locking tabs together so that the magazine spring may draw the tabs upwardly through the through hole in the baseplate assembly.

Once a user has loaded a desired number of cartridges 106 into the magazine housing 102, the user may unlock the follower 204 and allow the spring 108 to decompress by releasing the interlocked tabs 218 from the baseplate assembly 210, e.g., by pressing or pinching the tabs together with one's fingers as shown in FIG. 10, or by using a device that presses, deflects, or pinches the tabs together. Pinching the tabs 218 together causes them to deflect inwardly toward one another such that respective upper edges of the tabs no longer engage a bottom of the baseplate assembly 210 and the tabs are free to be drawn up through the through hole 222 by decompression of the spring 108 against the follower 204.

Figure 11:
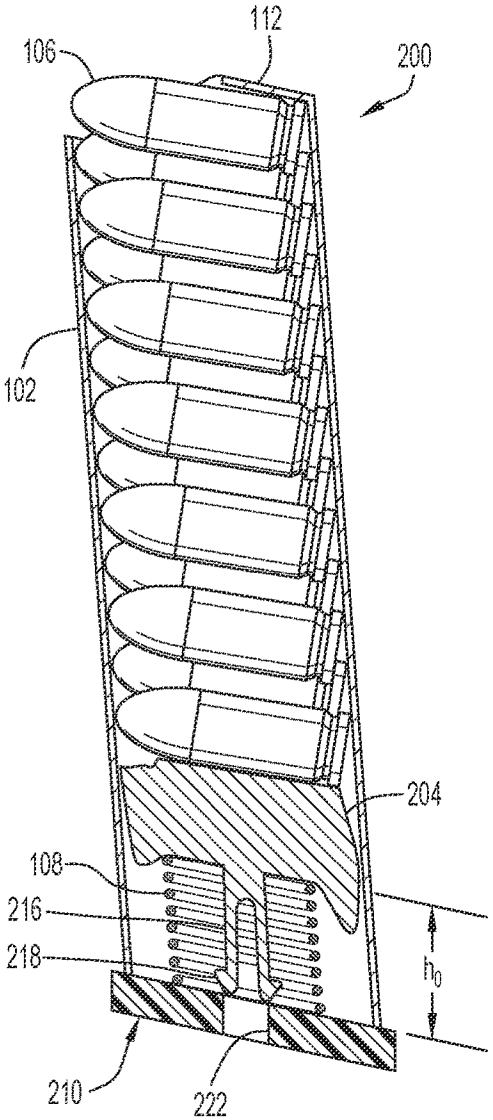
FIG. 11 is a cross-sectional side view of the magazine according to the first example embodiment showing the magazine in a fully loaded condition or state in which a maximum number of rounds have been loaded into the housing and are held in compression between the follower and lips at the top of the housing by the spring.

FIG. 11 shows how, after the tabs 218 have been released, decompression of the spring 108 will cause all of the cartridges 106 loaded into the magazine to be held in compression between the follower and the feed lips 112 and how the flexible protrusions 216 may return to their undeflected state. The magazine 200 may then be inserted into a firearm, and the firearm's slide or bolt may be operated to strip a cartridge from a top of the magazine and load the cartridge into the firing chamber of the firearm.

Figure 14:
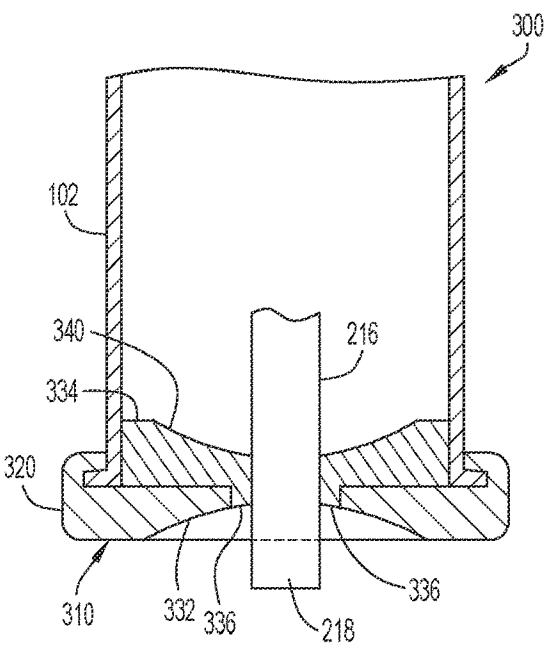
FIG. 14 is a cross-sectional view of a bottom portion of the magazine according to the second example embodiment taken through line 14-14 in FIG. 12.
Figure 13:
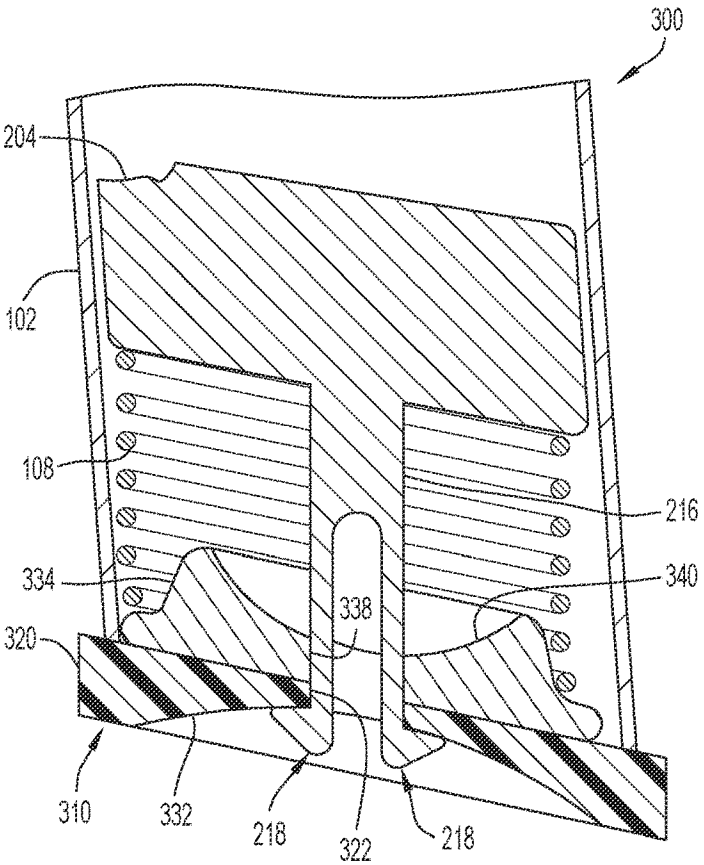
FIG. 13 is a cross-sectional side view of the magazine according to the second example embodiment taken through line 13-13 in FIG. 12.
Figure 12:
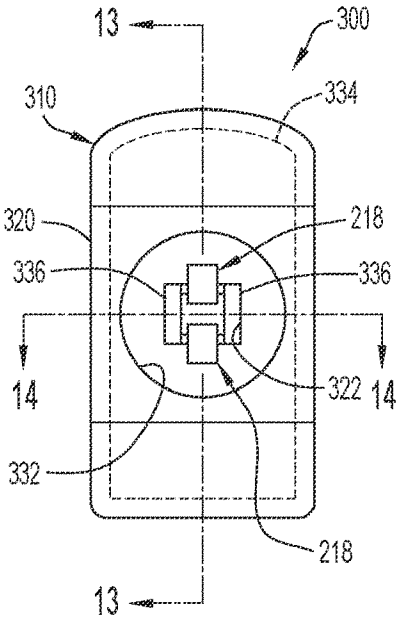
FIG. 12 is a bottom view of a magazine according to a second example embodiment in which a base plate assembly includes a base plate that engages a bottom of a tubular housing and a retainer plate with pins that extend into an opening in the base plate and in which locking tabs of a spring locking device extend through the base plate and the retainer plate.

FIGS. 12-14 show a magazine 300 according to a second example embodiment with a modified baseplate assembly 310. Other features of the magazine 300, such as the housing 102, the follower 204, and the spring 108, may be the same as or similar to the magazine 200 according to the first example embodiment. The second example embodiment may also be loaded with rounds in essentially the same manner as the first example embodiment. The modified baseplate assembly 310 includes a baseplate 320 with a rectangular through hole 322 that is similar to the baseplate in the first example embodiment but with a concave recess 332 (e.g., a recess having the shape of a spherical segment) in a bottom of the baseplate around the through hole. The recess 332 creates a protected space for the locking tabs 218 of the spring locking device so that, when the tabs protrude from the through hole 322 and lock against the bottom of the recess, they are less likely to be inadvertently bumped and released.

The modified baseplate assembly 310 further comprises a retainer plate 334 configured to be disposed within the housing 102 above the baseplate 320 and including pins 336 that extend downwardly from the retainer plate into the through hole 322 in the baseplate to prevent the baseplate from becoming inadvertently dislodged from the housing. For example, if the baseplate 320 is configured to slide onto rails or flanges at the bottom of the housing 102, the pins 336 extending down from the retainer plate 334 into the through hole 322 may keep the baseplate from sliding off the housing.

The pins 336 of the retainer plate 334 are spaced apart in the modified baseplate assembly 310, and a second through hole 338 is formed through the retainer plate between the pins and lined-up with the through hole 322 in the base plate 320 so that the locking tabs 218 of the spring locking device may extend through both the retainer plate and the base plate to lock the spring 108 in a compressed condition or state. A top of the retainer plate 334 may also include a concave recess 340 (e.g., a recess having the shape of an inverted conical frustum) around the second through hole 338 to help deflect the tabs 218 toward the through holes in the retainer plate and baseplate as the follower is depressed into the housing 102.

Figure 15:
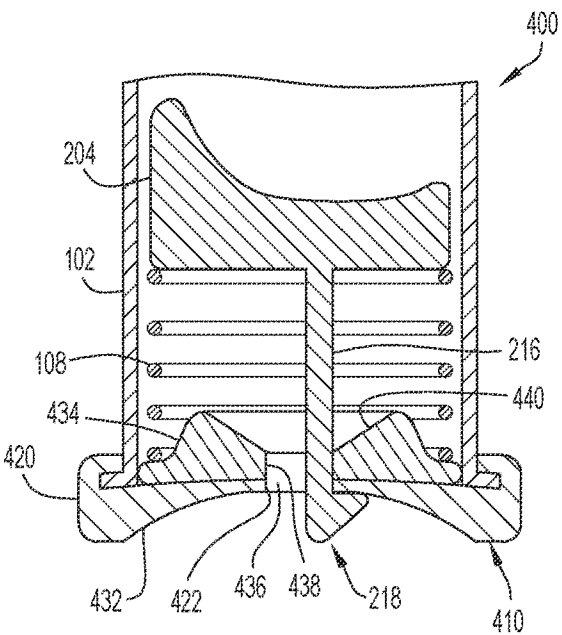
FIG. 15 is cross-sectional rear view of a bottom portion of a magazine according to a third example embodiment in which a concave groove is formed in a bottom surface of a base plate assembly parallel to a longitudinal axis of the follower and a concave recess is formed around the through hole on an upper surface of the base plate assembly.

FIG. 15 shows a bottom portion of a magazine 400 according to a third example embodiment with a modified spring locking device utilizing a single locking tab 218. Other features of the magazine, such as the housing 102 and the spring 108, may be the same as or similar to the magazine according to the first and second example embodiments. The third example embodiment may also be loaded with rounds in essentially the same manner as the first and second example embodiments, except that in the third example embodiment, the user only needs to release a single locking tab 218 in order to allow the spring 108 to decompress after loading rounds into the magazine. In the third example embodiment, the follower 204 includes only one flexible protrusion 216 with a locking tab 218, and the bottom of the baseplate 420 includes a groove 432 intersecting the through hole 422. The groove 432 in the bottom surface of the base plate assembly is oriented parallel to a longitudinal axis of the follower 204 (i.e., front to back). Like the concave recess in the second example embodiment, the groove 432 in the third example embodiment creates a protected space for the locking tab 218 of the spring locking device so that, when the tab protrudes from the through hole 422 and locks against the bottom of the groove, it is less likely to be inadvertently bumped and released. In addition, like the second example embodiment, the baseplate assembly 410 includes a retainer plate 434 with a concave recess 440 (e.g., a recess having the shape of an inverted conical frustum) formed around a through hole 438 in the retainer plate to deflect the tab 218 toward the through hole. In this example embodiment, pins 436 are similar to those in the second example embodiment but extend downwardly from the retainer plate 434 into the through hole 422 in the base plate 420 forwardly and rearwardly of the tab 218.

Figure 16:
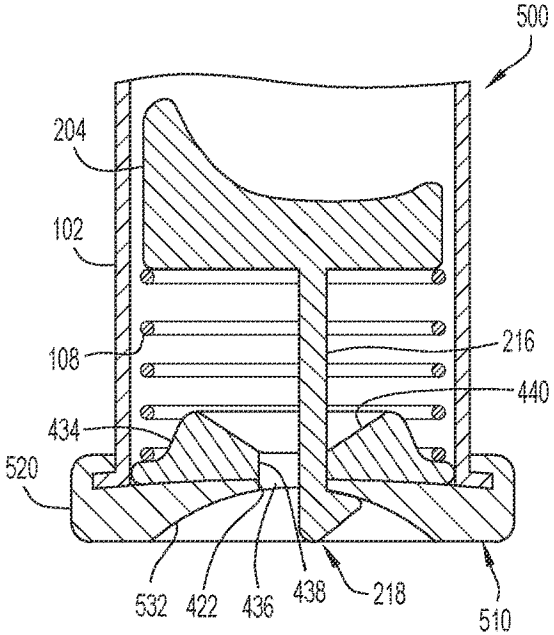
FIG. 16 is cross-sectional rear view of a bottom portion of a magazine according to a fourth example embodiment in which concave recesses are formed around the through hole in top and bottom surfaces of a base plate assembly.

FIG. 16 shows a bottom portion of a magazine 500 according to a fourth example embodiment with a modified spring locking device utilizing a single locking tab 218. Other features of the magazine, such as the housing 102 and the spring 108, may be the same as or similar to the magazine according to the first through third example embodiments. The fourth example embodiment may also be loaded with rounds in essentially the same manner as the third example embodiment, in that the user only needs to release a single locking tab 218 in order to allow the spring 108 to decompress after loading rounds in the magazine. Like the third example embodiment, the follower 204 in the fourth example embodiment includes only one flexible protrusion 216 with a locking tab 218. However, in the fourth example embodiment, the bottom of the baseplate 520 includes a concave recess 532 (e.g., a recess having the shape of a conical frustum or a spherical segment) around the through hole 422 instead of a groove to create a protected space for the locking tab 218 of the spring locking device. In addition, like the second and third example embodiments, the baseplate assembly 510 in the fourth example embodiment includes a retainer plate 434 with a concave recess 440 (e.g., a recess having the shape of an inverted conical frustum) formed around a through hole 438 in the retainer plate to deflect the tab 218 toward the through hole. Like the third example embodiment, pins 436 extend downwardly from the retainer plate 434 into the through hole 422 in the base plate 520 forwardly and rearwardly of the locking tab 218.

Figure 17:
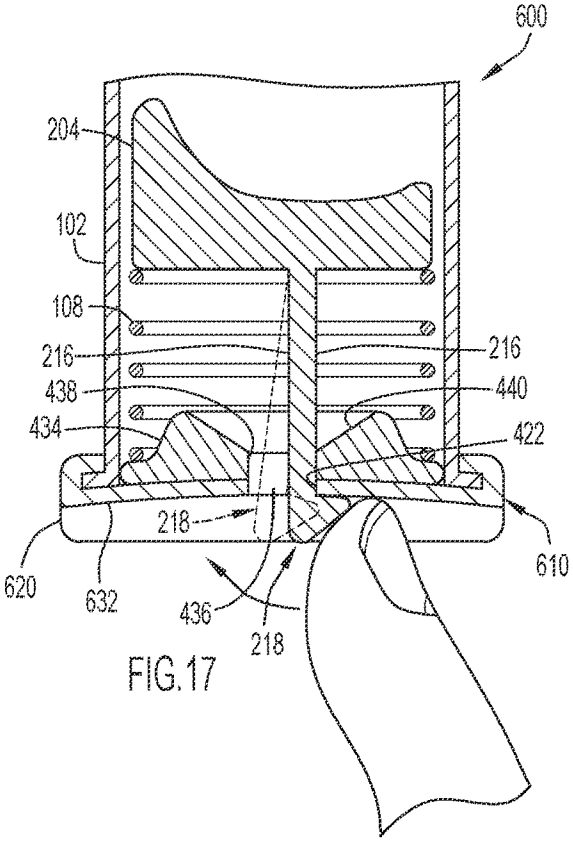
FIG. 17 is cross-sectional rear view of a bottom portion of a magazine according to a fifth example embodiment in which a concave groove is formed in a bottom surface of a base plate assembly perpendicular to a longitudinal axis of the follower and a concave recess is formed around the through hole on an upper surface of the base plate assembly.

FIG. 17 shows a bottom portion of a magazine 600 according to a fifth example embodiment with a modified spring locking device utilizing a single locking tab 218. Other features of the magazine, such as the housing 102 and the spring 108, may be the same as or similar to the magazine according to the first through fourth example embodiments. The fifth example embodiment may also be loaded with rounds in essentially the same manner as the third and fourth example embodiments, in that the user only needs to release a single locking tab 218 in order to allow the spring 108 to decompress after loading rounds in the magazine. Like the third and fourth example embodiments, the follower 204 in the fifth example embodiment includes only one flexible protrusion 216 with a locking tab 218. However, in the fifth example embodiment, a groove 632 is formed laterally across the bottom surface of the baseplate 620 perpendicular to a longitudinal axis of the follower to create a protected space for the locking tab 218 of the spring locking device. In addition, like the second third, and fourth example embodiments, the baseplate assembly 610 in the fifth example embodiment includes a retainer plate 434 with a concave recess 440 (e.g., a recess shaped like an inverted conical frustum) formed around a through hole 438 in the retainer plate to deflect the tab 218 toward the through hole. Like the third and fourth example embodiments, pins 436 extend downwardly from the retainer plate 434 into the through hole 422 in the base plate 620 forwardly and rearwardly of the locking tab 218.

Figure 19:
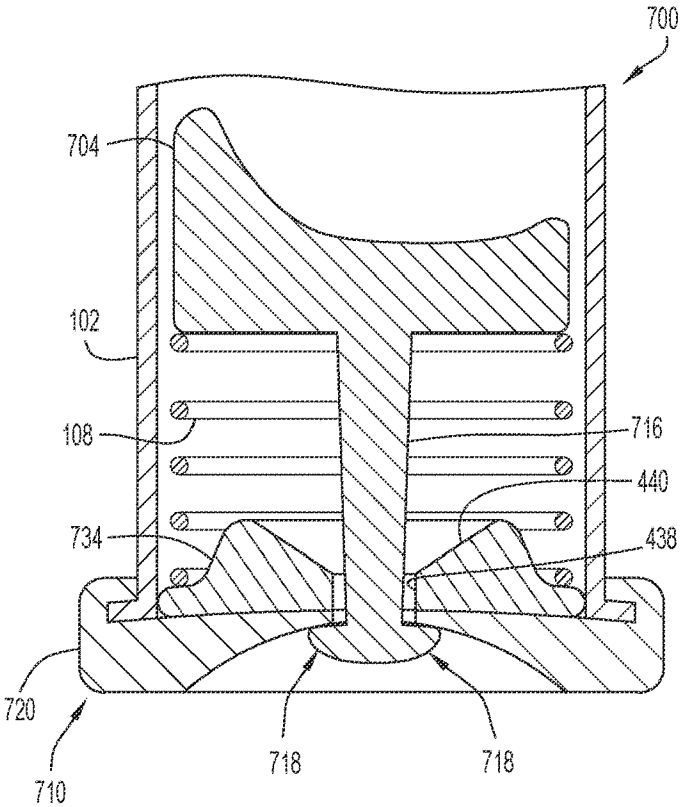
FIG. 19 is a cross-sectional side view of a bottom portion of the magazine according to the sixth example embodiment, taken through line 19-19 in FIG. 18.
Figure 18:
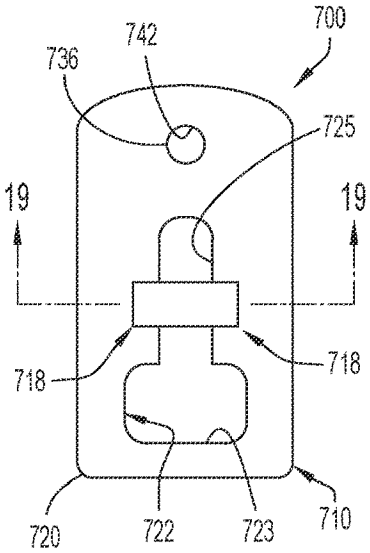
FIG. 18 is a bottom view of a magazine according to a sixth example embodiment in which the tab and the through hole are generally T-shaped.

FIGS. 18 & 19 show bottom and partial rear views of a magazine 700 according to a sixth example embodiment in which the spring locking device includes a modified follower 704 with a single flexible protrusion 716 having a pair of locking tabs 718 extending therefrom in opposite directions. The sixth example embodiment also includes a baseplate assembly 710 in which the through hole 722 is defined by a pair of intersecting slots that resemble a "T" when viewed from below. The cross-wise slot 723 is oriented parallel to the plane defined by the tabs 718 and is preferably of sufficient size to allow the tabs to pass through the cross-wise slot when the follower 704 is pushed downwardly to the loading position. The connecting slot 725 extends perpendicularly from a center of the cross-wise slot 723 and is narrower than a combined width of the tabs 718, but wide enough to accommodate a portion of the flexible protrusion 716 proximal of the tabs, so that the flexible protrusion may fit within the connecting slot and the tabs may engage the bottom surface of the baseplate 720 on opposite sides of the connecting slot to lock the spring 108 in a compressed state or condition. In a modification of the sixth example embodiment, a round portion with a width that is wider than a combined width of the tabs may be used instead of a cross-wise slot and the connecting slot may extend radially from the round portion. Also, like the third, fourth, and fifth example embodiments, the baseplate assembly 710 in the sixth example embodiment may include a retainer plate 734 with a concave recess 440 (e.g., a recess shaped like an inverted conical frustum) formed around the through hole 438 in the retainer plate to deflect the tab toward the cross-wise slot. Retainer plate 734 differs from the retainer plates in the third, fourth, and fifth example embodiments in that it includes a pin 736 that is aligned with a separate pin-receiving opening 742 formed in the baseplate 720, instead of extending through the tab-receiving through hole. Other features of the magazine, such as the housing 102 and the spring 108, may be the same as or similar to the magazine according to the first through fifth example embodiments. The sixth example embodiment may also be loaded with rounds in essentially the same manner as the third, fourth and fifth example embodiments, in that the user only needs to release a single locking tab 718 in order to allow the spring 108 to decompress after loading rounds in the magazine. However, in the sixth example embodiment, to release the locking tab 718, the user may slide the tab rearwardly along the connecting slot 725 until it reaches the cross-wise slot 723 and is pulled upwardly through the cross-wise slot by decompression of the spring 108.

Figure 20:
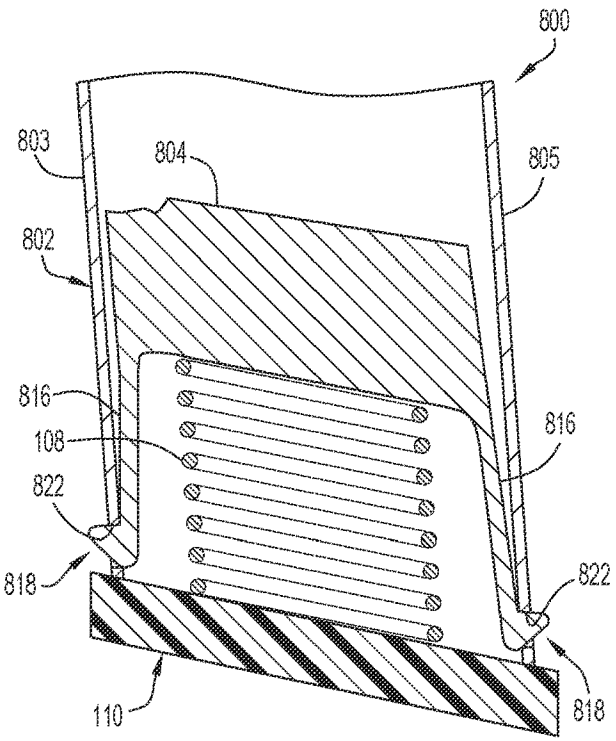
FIG. 20 is a cross-sectional side view of a bottom portion of a magazine according to a seventh example embodiment in which the spring locking device includes tabs configured to extend through openings in the tubular portion of the magazine housing to lock the follower in a loading position proximate a bottom of the magazine and the spring in a compressed state or condition between the follower and the bottom of the magazine.

FIG. 20 shows a bottom portion of a magazine 800 according to a seventh example embodiment in which the spring locking device includes a modified follower 804 having tabs 818 configured to extend through through holes 822 in side walls 803 and 805 (e.g., front and rear side walls as shown, or left and right side walls) of the magazine housing 102 to lock the follower 804 in a loading position proximate a bottom of the magazine and the spring 108 in a compressed state or condition between the follower and the bottom of the magazine. The tabs 818 are disposed at distal ends of a pair of flexible protrusions 816 extending downwardly from opposite ends of the follower 804 (e.g., front and back as shown, or left and right) outside the coils of the spring 108. The tabs 818 may have the same general shape as the tabs in the other example embodiments and may extend in opposite directions from their respective flexible protrusions 816. To cause the tabs 818 to click into the through holes 822, the flexible protrusions 816 may be normally held in a deflected state in the housing 802 so that they move to an undeflected state by virtue of their elasticity when the tabs line-up with the through holes, or the flexible protrusions may normally be held in an undeflected state and be caused to deflect immediately prior to lining-up with the through holes (e.g., using ramps inside the housing 802) after which they may move back to the undeflected state when the tabs line-up with the through holes. Other features of the magazine 800, such as the baseplate assembly 110 and the spring 108, may be the same as or similar to conventional magazines. The seventh example embodiment may also be loaded with rounds in essentially the same manner as the other example embodiments, except that a user may release the spring locking device by depressing the tabs 818 into the tubular housing 802 so that the follower 804 is unlocked from the loading position and the spring 108 may decompress.

Figure 21A:
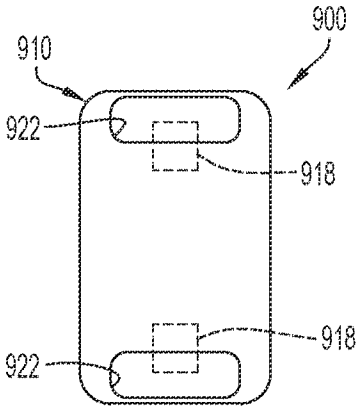
FIG. 21A is a bottom view of a magazine according to an eighth example embodiment showing two through holes formed proximate front and rear ends of a base plate assembly.

FIG. 21A is a bottom view of a magazine 900 according to an eighth example embodiment showing two through holes 922 formed proximate front and rear ends of a base plate assembly 910 to receive tabs 918 on flexible protrusions extending from front and rear ends of the follower. Alternatively, similar through holes can be formed proximate right and left sides of the base plate in alignment with flexible protrusions on the follower. In either case, the tabs may be oriented to face toward one another (e.g., as shown) or away from one another. Other features of the magazine, such as the housing and the spring, may be the same as or similar to conventional magazines. The eighth example embodiment may be loaded with rounds in essentially the same manner as the other example embodiments.

Figure 21B:
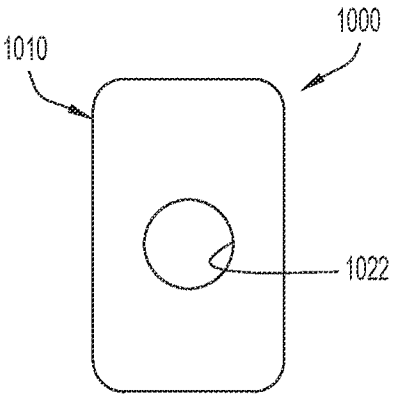
FIG. 21B is a bottom view of a magazine according to a ninth example embodiment showing a circular through hole formed through a base plate assembly.

FIG. 21B is a bottom view of a magazine 1000 according to a ninth example embodiment showing a circular through hole 1022 formed through a base plate assembly 1010 to receive one or more tabs. Other features of the magazine, such as the follower, the housing and the spring, may be the same as or similar to the other example embodiments. The ninth example embodiment may be loaded with rounds in essentially the same manner as the other example embodiments.

Figure 21E:
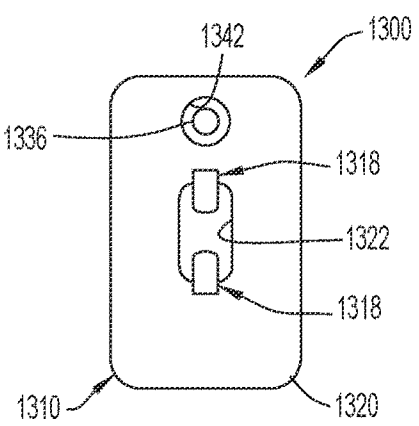
FIG. 21E is a bottom view of a magazine according to a twelfth example embodiment showing an elongated rectangular tab-receiving through hole and a separate pin-receiving opening formed through a base plate assembly.
Figure 21D:
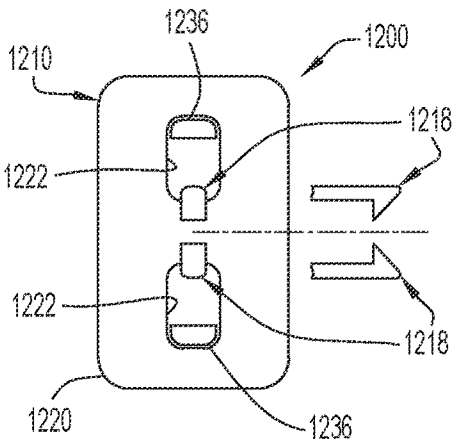
FIG. 21D is a bottom view of a magazine according to an eleventh example embodiment showing a pair of rectangular through holes formed through a base plate assembly and tabs that extend towards one another to engage a portion of the base plate between the rectangular through holes.
Figure 21C:
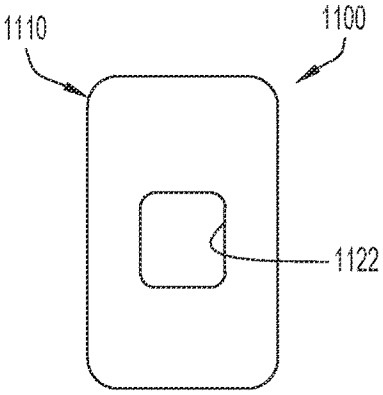
FIG. 21C is a bottom view of a magazine according to a tenth example embodiment showing a rectangular through hole formed through a base plate assembly.

FIG. 21C is a bottom view of a magazine 1100 according to a tenth example embodiment showing a rectangular through hole 1122 formed through a base plate assembly 1110 to receive one or more tabs. The rectangular through hole 1122 may be square (i.e., the length and width of the hole are the same) or elongated in one direction (i.e., length of hole in one direction is greater than its width in an orthogonal direction). Other features of the magazine, such as the follower, the housing and the spring, may be the same as or similar to the other example embodiments. The tenth example embodiment may be loaded with rounds in essentially the same manner as the other example embodiments.

FIG. 21D is a bottom view of a magazine 1200 according to an eleventh example embodiment showing a pair of rectangular through holes 1222 formed through a base plate assembly 1210 and tabs 1218 that extend towards one another to engage a portion of the base plate 1220 between the rectangular through holes. The eleventh example embodiment also includes retaining pins 1236 located at opposite ends of the through holes 1222 relative to the tabs. Other features of the magazine, such as the follower, the housing and the spring, may be the same as or similar to the other example embodiments. The eleventh example embodiment may be loaded with rounds in essentially the same manner as the other example embodiments.

FIG. 21E is a bottom view of a magazine 1300 according to a twelfth example embodiment showing an elongated rectangular tab-receiving through hole 1322 formed through a base plate assembly 1310 and a separate pin-receiving opening 1342 formed through the base plate 1310. Through hole 1322 may be configured to receive a plurality of tabs 1318 (e.g., a pair of tabs facing away from each other as shown) or a single tab. Opening 1342 may be configured to receive a pin 1336 extending from a retainer plate. Other features of the magazine, such as the follower, the housing and the spring, may be the same as or similar to the other example embodiments. The twelfth example embodiment may be loaded with rounds in essentially the same manner as the other example embodiments.

Figure 23:
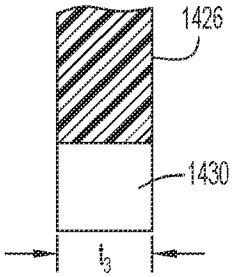
FIG. 23 is a cross-sectional view of a distal end portion of the pusher according to the thirteenth example embodiment, taken through line 23-23 in FIG. 22.
Figure 22:
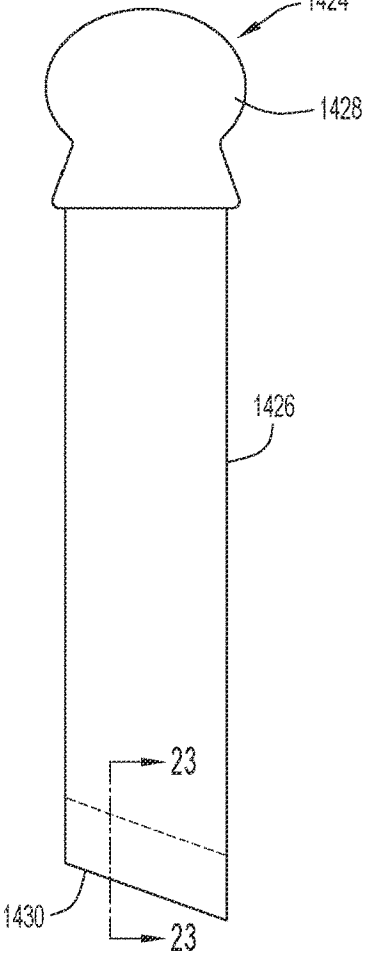
FIG. 22 is a side view of a pusher for compressing a magazine spring in accordance with a thirteenth example embodiment.

FIGS. 22 & 23 show a pusher 1424 for compressing a magazine spring in accordance with a thirteenth example embodiment. Like the pusher shown in FIGS. 5 and 6, the pusher 1424 in accordance with the thirteenth example embodiment includes a main shaft 1426 with proximal and distal ends. A handle 1428 is disposed at the proximal end of the main shaft 1426, and the distal end 1430 is angled to match the angle of a follower in a magazine. The main shaft 1426 preferably has a thickness $t_3$ small enough to fit between the feed lips of the magazine, and a width $w_3$ small enough to fit between front and rear walls of the magazine housing. The handle 1428 is shown as a ball-like member. Other features of the pusher 1424, such as the main shaft, may be the same as or similar to the pushers described in other example embodiments.

Figure 25A:
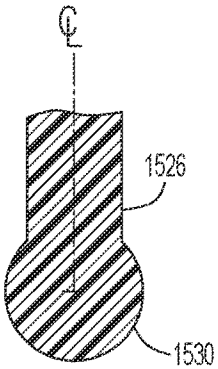
FIGS. 25A and 25B are cross-sectional views of the distal end portion of the pusher according to the fourteenth example embodiment, taken through line 25A,B-25A,B in FIG. 24.
Figure 25B:
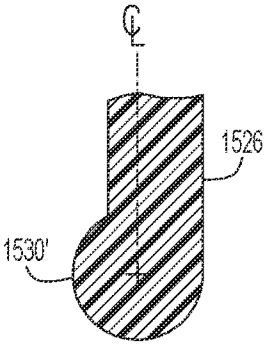
Figure 24:
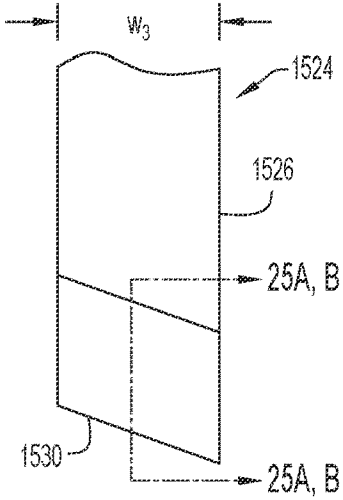
FIG. 24 is a side view of a distal end portion of a pusher for compressing a magazine spring in accordance with a fourteenth example embodiment.

FIG. 24 shows a bottom portion of a pusher 1524 for compressing a magazine spring in accordance with a fourteenth example embodiment. The pusher 1524 according to the fourteenth example embodiment is essentially same as the thirteenth embodiment; however, as best seen in FIGS. 25A and 25B, a distal end 1530 of the pusher is thicker than the main shaft 1526 of the pusher and therefore unable to pass through the gap between the feed lips to improve safety by preventing the pusher from accidentally being ejected from the magazine if the spring unexpectedly decompresses. Preferably, the distal end 1530 of the pusher is of generally cylindrical configuration, with a diameter about the same as a cartridge casing. The generally cylindrical distal end 1530 may also be tilted to match the angle of a follower. The central longitudinal axis of the generally cylindrical distal end of the pusher may be concentric with a central longitudinal axis of the main shaft to accommodate single column magazines (e.g., as shown in FIG. 25A at 1530), or the central longitudinal axis of the generally cylindrical distal end of the pusher may be offset from the central longitudinal axis of the main shaft to accommodate dual column magazines (e.g., as shown in FIG. 25B at 1530'). In use, the enlarged distal end 1530 or 1530' of the pusher 1524 according to the fourteenth example embodiment may be inserted into the front portion of the top opening of a magazine, pressed against the follower, and slid under the feed lips. Since the main shaft is thin enough to fit between the feed lips, the pusher may be pushed downwardly by the user to lock the follower in the loading position and hold the spring in a compressed state. If the spring is somehow released prematurely, the enlarged distal end will be caught by the feed lips, thereby preventing the pusher from being ejected from the magazine. Other features of the pusher 1524, such as the main shaft and the handle, may be the same as or similar to the pushers in the first, thirteenth, and fifteenth example embodiments.

Figure 26:
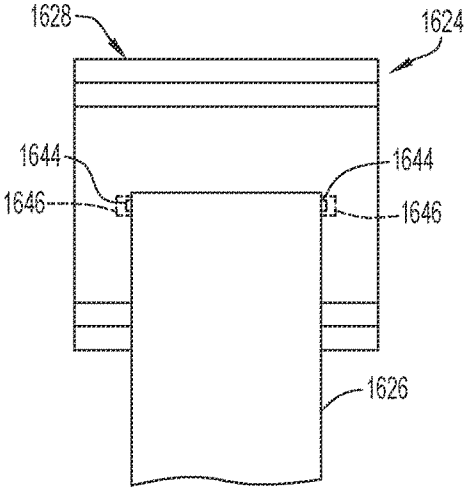
FIG. 26 is a side view of a proximal end portion of a pusher with a folding handle in a folded position according to a fifteenth example embodiment.
Figure 27:
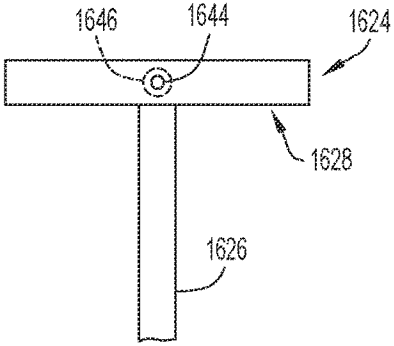
FIG. 27 is a side view of a proximal end portion of a pusher with a folding handle in an unfolded position according to the fifteenth example embodiment.

FIG. 26 is a side view of a proximal end portion of a pusher 1624 with a folding handle 1628 in a folded position according to a fifteenth example embodiment, and FIG. 27 is a front view of a proximal end portion of the same pusher with the folding handle in an unfolded position. The handle 1628 may be hinged to the main shaft of the pusher by hinge pins 1644 as shown or any other suitable coupling. For example, two pins 1644 may be molded onto the main shaft and configured to fit into recesses 1646 formed in the folding handle. Alternatively, the pins 1644 may be molded onto the handle and configured to fit into recesses on the main shaft. In either case, the recesses are preferably configured to allow the pins to be "snapped" into the recesses during assembly. Other features of the pusher 1624, such as the main shaft and the distal end, may be the same as or similar to the pushers in the first, thirteenth, and fourteenth example embodiments.

The pushers described herein may be formed of any suitable material capable of pushing a follower to a loading position against the force of the spring, including but not limited to plastic, metal, wood, composite, and combinations of such materials. The various features of the pushers in the example embodiments described herein, such as the handles, the main shaft, and the distal ends, may be combined in any desired manner. It will also be appreciated that the pushers described herein may be used to compress the spring in any of the magazines described herein.

It will be appreciated that the follower and the baseplate assembly in each of the example embodiments together constitute a spring locking device or device that may be incorporated as part of a magazine during manufacturing or that may be retrofitted to an existing magazine that did not have spring locking functionality when it was manufactured. To retrofit the spring locking device into an existing magazine that did not have spring locking functionality when it was manufactured, the original baseplate assembly of the magazine may be removed (e.g., by sliding the original baseplate relative to the magazine housing so that it becomes disengaged from rails at the bottom of the magazine housing). With the baseplate assembly removed, the spring and the original follower are accessible from the bottom of the magazine housing and may be removed therefrom. The spring may be re-used, but the original follower is replaced with a new follower according to one of the example embodiments herein. The new follower and the spring may be reinstalled in the magazine housing. A new baseplate assembly according to one of the example embodiments may then be installed on the bottom of the housing to replace the original baseplate assembly. With the new follower and the new baseplate assembly installed, the magazine may be loaded in a manner described herein.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. For example, while the example embodiments include flexible protrusions with generally triangular tabs, it will be appreciated that other shapes may be used, including without limitation J-shaped tabs, L-shaped tabs, V-shaped tabs, T-shaped tabs, elliptical tabs, semicircular tabs, polygonal tabs, ball-shaped tabs, and combinations of the foregoing. A tab at the distal end of a flexible protrusion may extend forwardly, rearwardly, to the right, to the left, or in any other direction from the distal end of the flexible protrusion. When multiple flexible protrusions are provided, the tabs on the flexible protrusions may face toward one another, away from one another, in parallel directions, in perpendicular directions, or in any other directions relative to one another. Additionally, when multiple flexible protrusions are provided, the tabs may be received by a single through hole serving all of the flexible protrusions, or several through holes may be provided so that each tab is received by a different through hole. The through hole may be rectangular, square, triangular, hexagonal, octagonal, polygonal, slotted, elliptical, circular, T-shaped, L-shaped, X-shaped, or a combination of two or more of the foregoing. The flexible protrusions in the example embodiments may be formed with the rest of the follower as an integral one-piece unit, or the flexible protrusions may be formed separately from other parts of the follower and joined together using any suitable fastening technique, including without limitation bonding with an adhesive, sonic welding, etc. While the example embodiments have been explained with reference to magazines holding specific numbers of cartridges, it will be appreciated that the principles of the embodiments may be applied to magazines irregardless of the number of cartridges they are designed to hold. Furthermore, while the example embodiments have been explained primarily with reference to a double stack magazine, the principles of the embodiments may also be applied to a single stack magazine. Also, while the example embodiments have been explained with reference to handgun magazines, it will be appreciated that the principles of the embodiments may also be applied to rifle magazines. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A device for locking a spring in a compressed state in the housing of a magazine to facilitate loading the magazine, the device comprising:

a follower configured to fit within the magazine housing and to engage with a top of the spring, the follower including a top side configured to contact a cartridge loaded in the magazine, and a bottom side including a flexible protrusion extending therefrom and having a tab at a distal end thereof; and a through hole formed in a component of the magazine and configured to receive the tab when the follower is located in a loading position proximate a bottom of the magazine housing with the spring in a compressed state;

wherein the flexible protrusion is configured to be movable between an undeflected state and a deflected state, and wherein movement of the flexible protrusion from the deflected state to the undeflected state in the loading position causes the tab at the distal end of the flexible protrusion to extend at least partly through the through hole and to engage a portion of the magazine adjacent the through hole so as to lock the follower in the loading position and hold the magazine spring in the compressed state to facilitate loading the magazine;

wherein the component includes a base plate assembly configured to couple with a bottom of the magazine housing, and wherein the through hole is formed through the base plate assembly;

wherein the flexible protrusion is one of a plurality of flexible protrusions extending downwardly from the follower, wherein each of the flexible protrusions includes a tab at a distal end thereof; and wherein each tab is aligned with an edge of the through hole when a corresponding protrusion is in the undeflected state.

2. The device of claim 1, wherein the base plate assembly comprises a base plate configured to couple with the bottom of the magazine housing and a retainer plate configured to fit inside the magazine housing and including a pin configured to extend into an opening in the base plate to retain the baseplate on the magazine housing, and wherein the through hole is formed through the retainer plate and the base plate.

3. The device of claim 2, wherein the pin on the retainer plate is configured to extend into the through hole.

4. The device of claim 1, wherein the tab at the distal end of the flexible protrusion is configured to be aligned with an edge of the through hole when the flexible protrusion is in the undeflected state.

5. The device of claim 4, wherein the tab is configured to cause the flexible protrusion to be deflected laterally as the tab moves downwardly into the through hole and to lock against a bottom of the base plate assembly when the tab emerges from the through hole and the flexible protrusion returns toward the undeflected state.

6. The device of claim 5, wherein a length of the flexible protrusion from the follower to the tab is equal to or less than a height of the spring when a maximum number of cartridges are held in compression between the follower and a top of the housing.

7. The device of claim 1, wherein a height of the spring when the magazine is fully loaded with cartridges is greater than a height of the spring in the compressed state.

8. A firearm magazine comprising, a magazine housing and a base plate assembly coupled with a bottom of the magazine housing;

a spring disposed within the housing; and the device of claim 1.

9. The firearm magazine of claim 8, wherein the spring is a helical spring and wherein the flexible protrusion is configured to extend through a center portion of one or more coils of the helical spring.

10. The firearm magazine of claim 8, wherein the spring is a helical spring and wherein the flexible protrusion is configured to extend from the follower outside coils of the helical spring.

11. A system for loading a magazine, the system comprising:

the device of claim 1; and a pusher configured to engage a top side of the follower and to push the follower downwardly into the magazine in response to downward pressure applied by a user to the pusher, whereby the magazine spring may be compressed until the tab is received in the through hole.

12. The system of claim 11, wherein the pusher includes a main shaft configured to fit between feed lips of the magazine housing and wherein a distal end of the pusher is wider than a spacing between the feed lips.

13. The system of claim 12, wherein the distal end of the pusher is configured to conform to a top surface of the follower.

14. The system of claim 12, wherein the distal end of the pusher is shaped like a portion of a cartridge.

15. A device for locking a spring in a compressed state in the housing of a magazine to facilitate loading the magazine, the device comprising:

a follower configured to fit within the magazine housing and to engage with a top of the spring, the follower including a top side configured to contact a cartridge loaded in the magazine, and a bottom side including a flexible protrusion extending therefrom and having a tab at a distal end thereof; and a through hole formed in a component of the magazine and configured to receive the tab when the follower is located in a loading position proximate a bottom of the magazine housing with the spring in a compressed state;

wherein the flexible protrusion is configured to be movable between an undeflected state and a deflected state, and wherein movement of the flexible protrusion from the deflected state to the undeflected state in the loading position causes the tab at the distal end of the flexible protrusion to extend at least partly through the through hole and to engage a portion of the magazine adjacent the through hole so as to lock the follower in the loading position and hold the magazine spring in the compressed state to facilitate loading the magazine; wherein the component is a base plate assembly configured to couple with a bottom of the magazine housing, and wherein the through hole is formed through the base plate assembly; and wherein a top side of the base plate assembly includes a concave portion around the through hole.

16. The device of claim 15, wherein the flexible protrusion is configured to extend downwardly from the follower in alignment with the concave portion when the flexible protrusion is in the undeflected state.

17. A device for locking a spring in a compressed state in the housing of a magazine to facilitate loading the magazine, the device comprising:

a follower configured to fit within the magazine housing and to engage with a top of the spring, the follower including a top side configured to contact a cartridge loaded in the magazine, and a bottom side including a flexible protrusion extending therefrom and having a tab at a distal end thereof; and a through hole formed in a component of the magazine and configured to receive the tab when the follower is located in a loading position proximate a bottom of the magazine housing with the spring in a compressed state;

wherein the flexible protrusion is configured to be movable between an undeflected state and a deflected state, and wherein movement of the flexible protrusion from the deflected state to the undeflected state in the loading position causes the tab at the distal end of the flexible protrusion to extend at least partly through the through hole and to engage a portion of the magazine adjacent the through hole so as to lock the follower in the loading position and hold the magazine spring in the compressed state to facilitate loading the magazine; wherein the component is a base plate assembly configured to couple with a bottom of the magazine housing, and wherein the through hole is formed through the base plate assembly; and wherein a bottom side of the base plate assembly includes a concave portion around the through hole.

18. A device for locking a spring in a compressed state in the housing of a magazine to facilitate loading the magazine, the device comprising:

a follower configured to fit within the magazine housing and to engage with a top of the spring, the follower including a top side configured to contact a cartridge loaded in the magazine, and a bottom side including a flexible protrusion extending therefrom and having a tab at a distal end thereof; and a through hole formed in a component of the magazine and configured to receive the tab when the follower is located in a loading position proximate a bottom of the magazine housing with the spring in a compressed state;

wherein the flexible protrusion is configured to be movable between an undeflected state and a deflected state, and wherein movement of the flexible protrusion from the deflected state to the undeflected state in the loading position causes the tab at the distal end of the flexible protrusion to extend at least partly through the through hole and to engage a portion of the magazine adjacent the through hole so as to lock the follower in the loading position and hold the magazine spring in the compressed state to facilitate loading the magazine;

wherein the component is a base plate assembly configured to couple with a bottom of the magazine housing, and wherein the through hole is formed through the base plate assembly;

wherein the flexible protrusion is one of a plurality of flexible protrusions extending downwardly from the follower, wherein each of the flexible protrusions includes a tab at a distal end thereof; and wherein the respective tabs are configured to cause the respective flexible protrusions to be deflected toward one another as the tabs move downwardly into the through hole and to lock against a bottom of the base plate assembly when the tabs emerge from the through hole and the flexible protrusions return toward their respective undeflected states.

19. The device of claim 18, further comprising a plurality of through holes formed through the base plate assembly, wherein each tab is aligned with an edge of a corresponding one of the plurality of through holes when a corresponding one of the protrusions is in a respective undeflected state.

20. A method of loading a firearm magazine having a magazine housing, a base plate assembly coupled with a bottom of the magazine housing, a follower disposed within the magazine housing, and a spring disposed between the follower and the base plate assembly, the method comprising:

pushing the follower downwardly within the magazine housing using a pusher, thereby compressing the spring;

locking the follower in a loading position proximate a bottom of the magazine housing by causing a tab at a distal end of a flexible protrusion on the follower to be received in a through hole formed in a component of the magazine;

dropping one or more cartridges into the housing; and depressing the tab so that it is released from the through hole and the spring may decompress, thereby moving the follower upwardly within the magazine to a loaded position in which the one or more cartridges are held in compression between the follower and a top of the magazine;

wherein the component includes a base plate assembly configured to couple with a bottom of the magazine housing, and wherein the through hole is formed through the base plate assembly;

wherein the flexible protrusion is one of a plurality of flexible protrusions extending downwardly from the follower, wherein each of the flexible protrusions includes a tab at a distal end thereof; and wherein each tab is aligned with an edge of the through hole when a corresponding protrusion is in an undeflected state.

21. The method of claim 20, wherein locking the follower in the loading position comprises causing the tab at the distal end of the flexible protrusion to be received in a through hole formed in the base plate assembly.

22. The method of claim 20, wherein locking the follower in the loading position comprises causing the tab at the distal end of the flexible protrusion to be received in a through hole formed in a side wall of the magazine housing.

23. A method of adding a spring locking device to a firearm magazine having a magazine housing, an original base plate assembly coupled with a bottom of the magazine housing, an original follower disposed within the housing, and a spring disposed between the original follower and the original base plate assembly, the method comprising:

replacing the original follower with a replacement follower configured to fit within the magazine housing and to engage with a top of the spring, the replacement follower having a top side configured to contact a cartridge loaded in the magazine, and a bottom side including a flexible protrusion extending therefrom and having a tab at a distal end thereof; and forming a through hole in the magazine, the through hole being configured to receive the tab when the replacement follower is located in a loading position proximate a bottom of the magazine housing with the spring in a compressed state;

wherein the flexible protrusion is configured to move from a deflected state to an undeflected state in which the tab extends into the through hole and engages the magazine to lock the magazine spring in the compressed state to facilitate loading the magazine;

wherein the through hole is formed through the base plate assembly;

wherein the flexible protrusion is one of a plurality of flexible protrusions extending downwardly from the follower, wherein each of the flexible protrusions includes a tab at a distal end thereof; and wherein each tab is aligned with an edge of the through hole when a corresponding protrusion is in the undeflected state.

24. The method of claim 23, wherein forming a through hole in the magazine comprises replacing the original base plate assembly with a replacement base plate assembly having a through hole formed therein.

25. The method of claim 24, wherein the original base plate assembly includes an original retainer plate configured to fit within the housing above the original base plate and having a pin configured to fit within an opening in the original base plate, the method further comprising replacing the original retainer plate and the original base plate with a replacement retainer plate and a replacement base plate, wherein the replacement retainer plate includes a through hole formed therein in registration with a through hole in the replacement base plate.

* * * * *